US008666098B2

(12) United States Patent
Leeper

(10) Patent No.: US 8,666,098 B2
(45) Date of Patent: Mar. 4, 2014

(54) SINGLE EARPHONE FOR STEREO AND MONAURAL AUDIO DEVICES

(75) Inventor: Barry Leeper, Deerfield Beach, FL (US)

(73) Assignee: Scan Sound, Inc., Deerfield Beach, FL (US)

( * ) Notice: Subject to any disclaimer, the term of this patent is extended or adjusted under 35 U.S.C. 154(b) by 988 days.

(21) Appl. No.: 12/317,902

(22) Filed: Dec. 30, 2008

(65) Prior Publication Data

US 2010/0166237 A1 Jul. 1, 2010

(51) Int. Cl.
*H04R 5/02* (2006.01)

(52) U.S. Cl.
USPC ..... 381/309

(58) Field of Classification Search
USPC ..... 381/309–311
See application file for complete search history.

(56) References Cited

U.S. PATENT DOCUMENTS 4,712,250 A * 12/1987 Michels et al. ..... 455/20
5,355,416 A * 10/1994 Sacks ..... 381/17
5,771,441 A * 6/1998 Altstatt ..... 455/66.1
6,041,130 A * 3/2000 Goss ..... 381/374

* cited by examiner

*Primary Examiner* — Ori Nadav
(74) *Attorney, Agent, or Firm* — Robert C. Kain, Jr.

(57) ABSTRACT

A single Airbed style earphone employing a standard three-conductor stereo headphone plug is adapted to enable the use of one earpiece to hear the combined left and right channels of stereo audio in a single ear. The single Airbed invention employs a three-conductor plug and is wired in such a way that it may be used equally well with both stereo and mono audio devices without the need for any kind of adapter, switch or sensing circuit. A pair of resistors matches the impedance load of a stereo headphone set.

8 Claims, 5 Drawing Sheets

SINGLE EARPHONE FOR STEREO AND MONAURAL AUDIO DEVICES

BACKGROUND OF THE INVENTION

1. Field of the Invention

This invention relates to a single earpiece Headphone or Earphone that may be used with both monaural and stereo audio devices without the use of a switch or an adapter. More particularly, the present invention provides listeners with the ability to hear both stereo audio channels mixed together in a single earpiece when plugged into a three-conductor jack of a stereo system.

2. Background of the Invention

Existing Headphones and Earphones that are used for listening to stereo audio are designed with two separate earpieces, each of which individually employ integrated speaker elements that drive audio into a listener's ears in such a way that the listener can differentiate the audio in each ear. Nearly all commercially available audio content, including books on tape, radio and television broadcasts, movies and music are all being formatted in stereo, offering sufficient separation in the left and right audio channels to enable the listener to hear the audio as if they were hearing it live with their own two ears. Nearly all types of commercially made audio players, including CD-Players, DVD-Players, radios, computers, MP-3 players, cellular phones and a wide variety of personal audio players all are equipped with stereo circuits to play the two audio channels into stereo speakers, stereo headphones and stereo earphones.

People with unilateral hearing loss (single sided deafness/SSD) can hear normally (or better) in one ear, but have trouble hearing out of the other ear. Approximately 50,000 people each year are diagnosed with some form of single sided deafness. Over 31.5 million Americans suffer from hearing loss. That's one out of every ten people and one out of every four people over 65. These individuals are extremely frustrated with their limited ability to hear the content from both of the stereo audio channels. As a consequence, many listeners with SSD often use only one of the two earpieces of a stereo earphone and they miss some of the instruments or vocals in most of the audio content that has been designed for separation the kind of music which comes with full stereo enjoyment. A small number of hearing impaired individuals have found ways to convert their favorite MP-3 audio recordings into monaural format using digital mixing features that exist in some audio software programs, however this takes a lot of time and work to convert song after song so that their music collection can be heard without missing any content.

Some individuals with single sided deafness have opted to use a hardware solution, by inserting a stereo-to-mono adapter inline with a mono headphone or earphone. Unfortunately, most stereo-to-mono adapters are problematic because the earphone cord and adapter stick out like an extra appendage that will often snag on clothing or other objects and can easily damage the device they are plugged into to the point that the adapter, earphone and audio player connectors are easily snapped off and damage the audio player jack in the process. Thus, many people with a single ear hearing impairment often just make do with a standard stereo earphone, and only listen to one of the two available audio channels.

U.S. Pat. No. 6,711,268 B addresses the need for a headphone that will enable use with stereo or mono circuits, however the invention described in U.S. Pat. No. 6,711,268 B utilizes two earpieces and offers no provision for mixing the stereo channels so the headphones will not be beneficial to those who have single-sided deafness.

The prior art utilizes a sensing circuit to enable connectivity to either a mono or stereo circuit, whereas my design is simple and does not involve the use of any type of sensing circuitry. Therefore the headphones and earphones of the present invention can be made with fewer parts and will cost less to build and because it utilizes fewer parts, there is less that can go wrong or fail over time.

SUMMARY

The described invention has a plug that fits into most electronic audio devices without any adapters, keeping the connection lightweight and slim so it functions well with most all stereo audio devices in much the same way as the original earphones and headphones which come with the audio devices when they are sold. The user can simply plug in and use the single earpiece to hear both audio channels from all of their favorite audio devices, and hear the stereo channels mixed together into a single earpiece. There is no need to adapt anything or artificially mix the audio together, and both audio channels are heard in the single earpiece.

One might wonder why a person with single sided deafness might not just use a Monaural Headphone or Earphone with their favorite stereo music player. A monaural earplug uses a two-conductor plug, and when this two-conductor plug is inserted into a stereo jack, it actually shorts one of the stereo channels to ground, and only one of the two audio channels is then heard in the Headphone or Earphone. As a result of one channel being shorted to ground, the listener is only going to hear one of the two stereo channels, thereby missing half the audio content. This actually defeats the whole idea of trying to hear the two channels of the stereo system with a monaural headphone or earphone.

The described invention utilizes a three-conductor plug that is most commonly associated with portable electronic devices, such as computers, DVD players, CD players and MP-3 players. The 3.5 mm subminiature stereo plug can be easily adapted so that the same headphone or earphone can be used with all other stereo equipment. The three conductor stereo plug will work with all the audio devices without shorting either of the stereo audio channels to ground, making it compatible with most all stereo audio equipment. Additionally, the contacts of the three-conductor plug enable the described invention to be utilized with conventional monaural audio circuits generally, such as those found in devices like transistor. radios, tape recorders, walkie-talkies and police radio scanners. The described Single Stereo and Monaural Earphone is compatible with nearly all kinds of conventional stereo and monaural audio products without any adapters or the need for any kind of switch, making them suitable for use by any individual who wants to listen to audio in a single ear. This plug and play capability makes them suitable for people of every age.

Many individuals who have no hearing impairment have found that they want to use an Earphone or Headphone in only one ear, especially if the listener wants to keep their other ear open for hearing others around them. As a result, employees in the workplace may listen to music to help relax on the job, without losing the ability to hear what is going on in their surrounding environment. Bicyclists and joggers may use the described invention to listen to their favorite music, while maintaining close contact with their surroundings, such as nearby pedestrians, vehicles and even an occasional car horn, without being a hazard to those around them. Some running Marathons have actually banned the use of earphones during their running events, mainly because they might be jeopardizing themselves and others around them if they are not alert and aware of others around them. Some employers are now requiring employees to limit the use of headphones and earphones in the work place, unless the worker has one free ear open to be able to interact with those around them, making it highly practical to utilize the described invention to enable employees to enjoy some music while working, or even use their computer with the Earphone while training on their laptop or desktop computer.

Figure 2A:
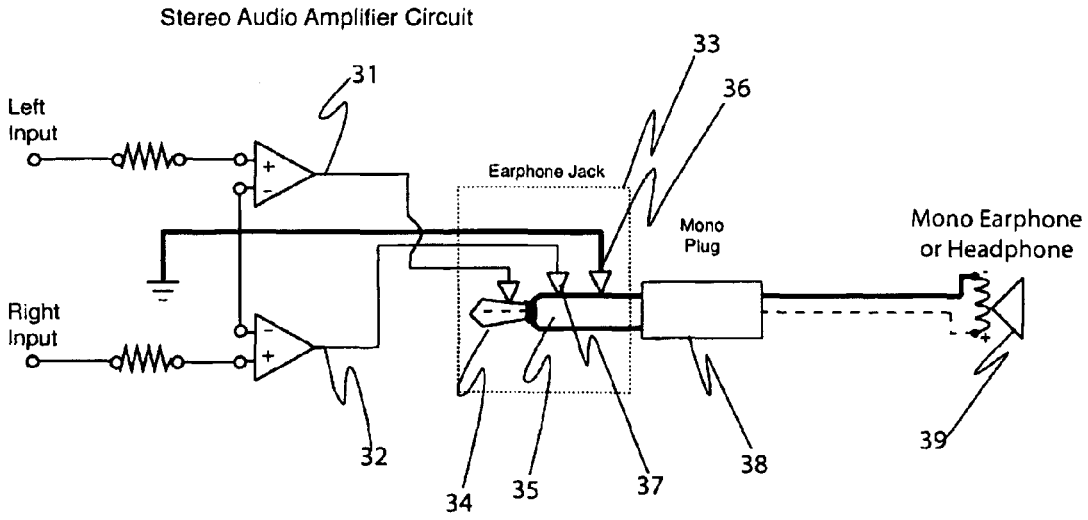
Figure 2A Prior Art
FIG. 2A is a drawing that demonstrates what occurs when a two-conductor Mono earphone plug is inserted into a three-conductor stereo audio earphone jack.
Figure 2B:
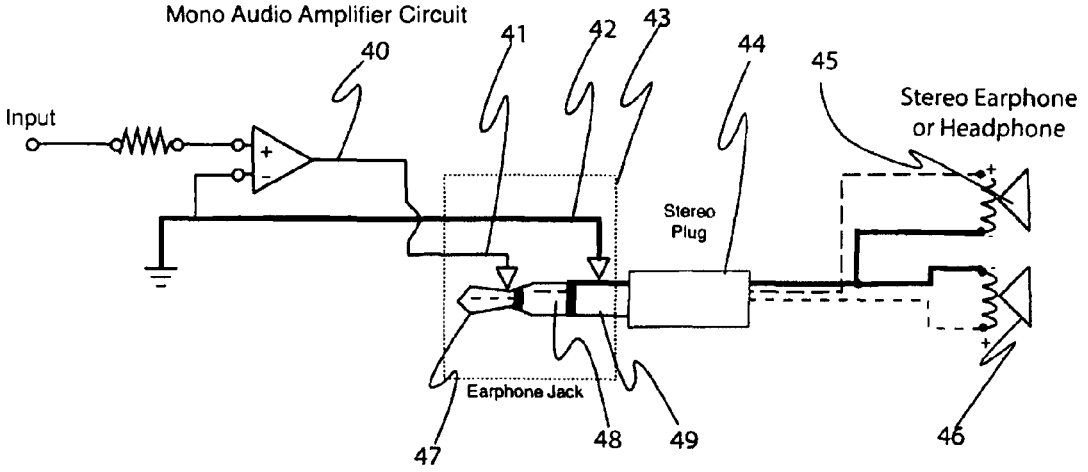
Figure 2B Prior Art

The drawing in FIG. 2B depicts a conventional monaural circuit and demonstrates what happens when a 3-conductor stereo headphone or earphone plug is inserted into a 2-conductor mono earphone jack.

Figure 3A:
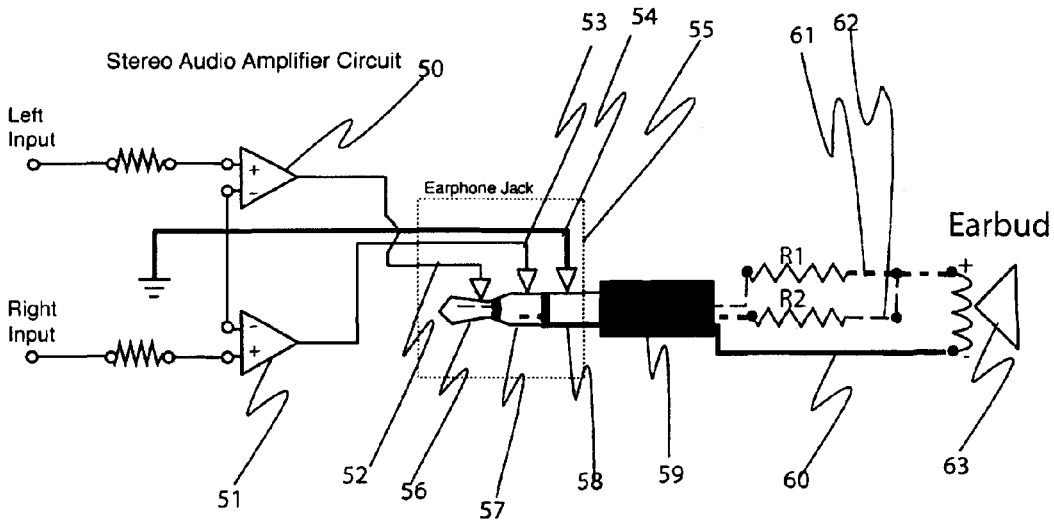

FIG. 3A shows what happens when the described single earpiece headphone invention is used with a stereo circuit.

Figure 3B:
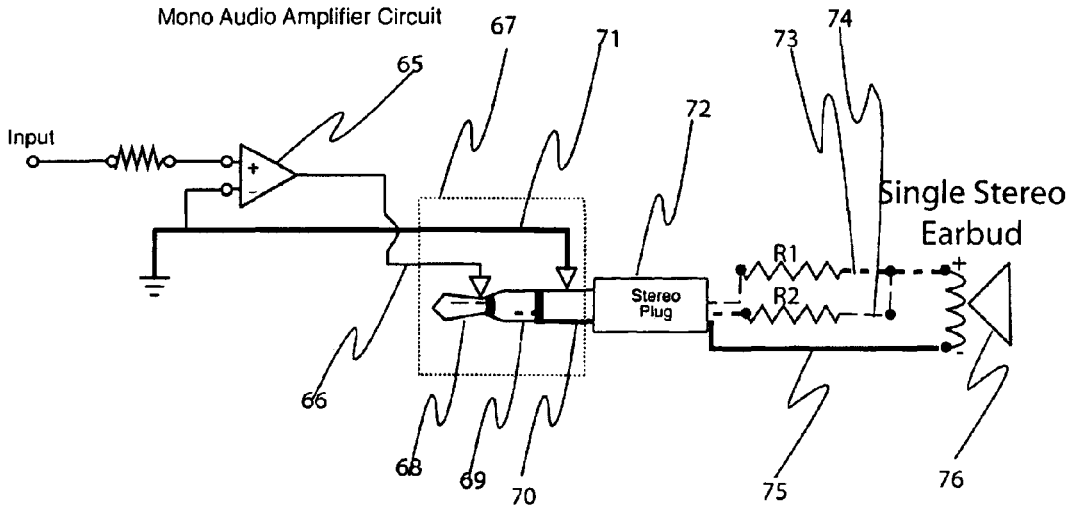

FIG. 3B shows what happens when the described single earpiece headphone invention is used with a monaural circuit.

Figure 4:
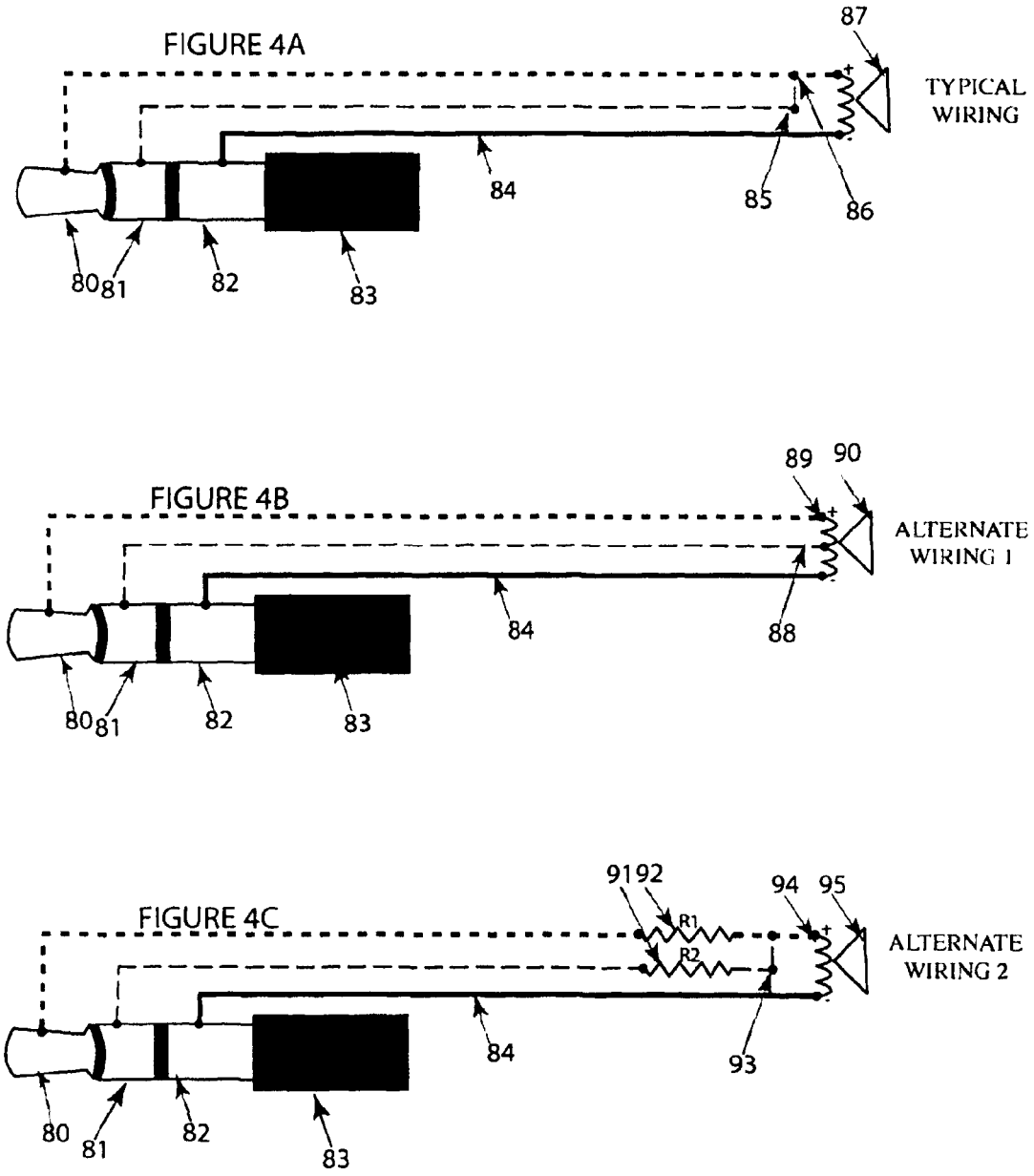

FIG. 4A shows the preferred embodiment of the described invention. In this diagram, the 3-conductor stereo connector connects to the single earpiece headphone or earphone 87 by way of a two or three conductor cable.

FIG. 4B shows another embodiment of the described invention, wherein each of the three conductors of the three-conductor plug 83 connects to an individual section of the voice coil of the Earphone 90.

FIG. 4C shows another embodiment of the described invention. In this drawing, the Left Channel audio makes contact with the connector plug 83 tip 80 and carries the left channel audio through the cable to resistor R1 92.

Figure 5A:
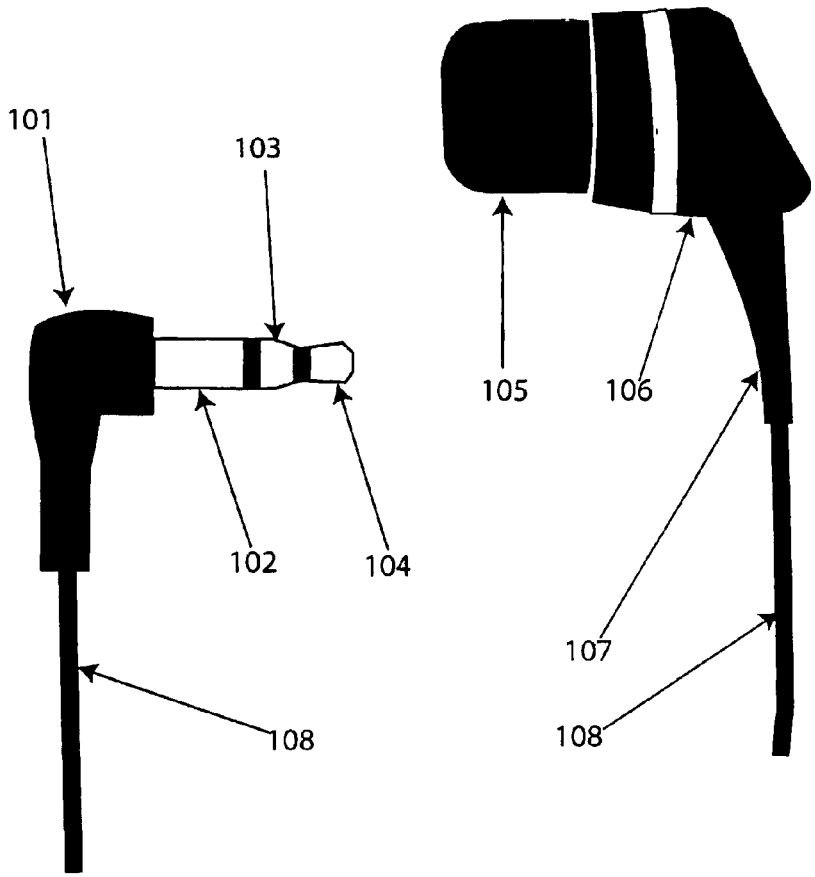

FIG. 5A is a pictorial drawing of a single Earphone 106 which has a rubberized ear tip 105 which is inserted into a person's ear.

Figure 5B:
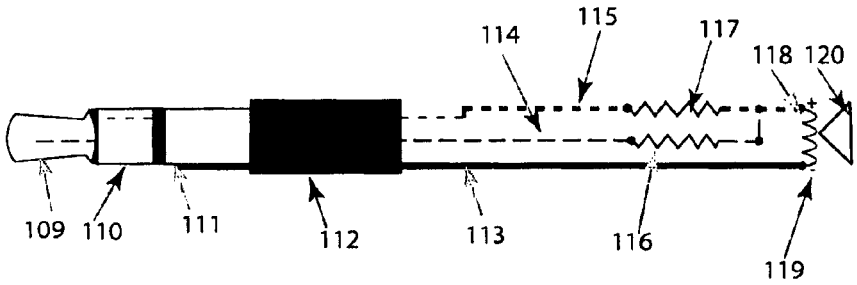

Referring to FIG. 5B, the diagram shows the preferred embodiment of the schematic drawing of the described. invention. The three-conductor audio plug 112 shown may be inserted into a monaural two-conductor jack or stereo three-conductor jack to provide audio to the earpiece 120.

DETAILED DESCRIPTION OF THE PREFERRED EMBODIMENTS

In accordance with the present design, a single earpiece headphone device is designed to function with both monaural and stereo equipment without the use of any switches, adapters or sensing circuitry. When the described single earpiece headphone/earphone is plugged into the audio jack of a stereo device, the listener will be able to hear both stereo channels combined together in the single earpiece. This single earpiece headphone or earphone will be ideal for the millions of individuals who suffer from a unilateral hearing loss, as it will enable the many who can hear in one ear only to easily connect this single earpiece headphone or earphone to any stereo or mono audio device and hear all the content, including music, voices and instruments from both stereo channels together in a single earpiece. Individuals with normal hearing will benefit from use of the single earpiece because they will be able to keep one ear open to traffic, pedestrians, horns and surrounding activities while listening to their favorite stereo audio player in their other ear, without missing any of the audio content from their stereo audio equipment.

In the drawings, closely related figures have the same number but different alphabetic suffixes.

Figure 1A:
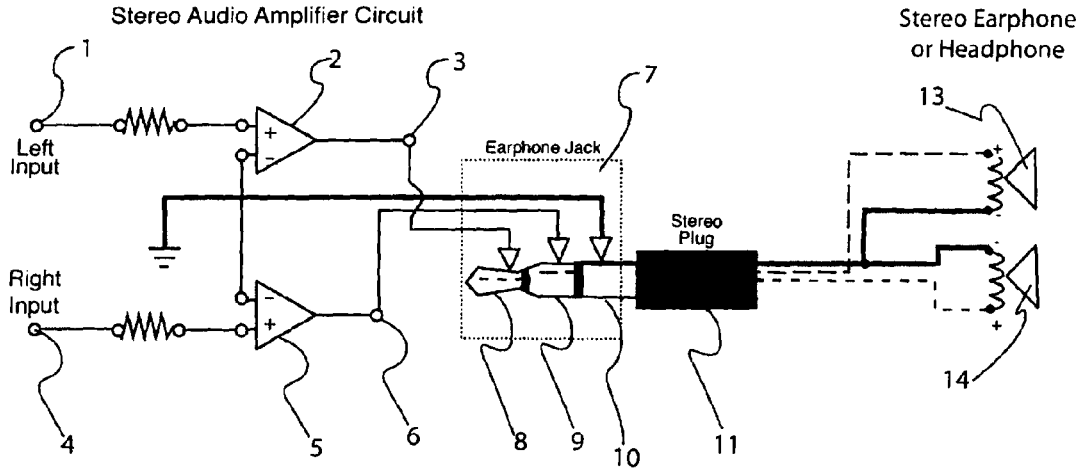
Figure 1A Prior Art
FIG. 1*a* is a drawing that depicts a conventional stereo circuit of an audio device such as an MP-3 player.

The many varying aspects of the described system are best appreciated when referring to the detailed description in relationship to the accompanying drawings, in which:

FIG. 1*a* is a drawing that depicts a conventional stereo circuit of an audio device such as an MP-3 player. The circuit consists of a Left Stereo input 1 that connects to a discrete audio amplifier 2 to create the Left Channel audio output 3. The Right channel audio, typically contains completely different sound from the left channel, which is amplified through a discreet audio amplifier 5 to create the Right Channel audio output 4. The right channel output 6 and left channel output 3 utilize a common ground to deliver two distinctly different audio signals at the Earphone jack 7. A Stereo earphone plug 11 is inserted into the Earphone jack 7 to conduct the Left channel audio 3 to the earphone plug tip 8. The right channel audio 6 conducts the audio output at the Earphone jack to the center earphone connector ring 9, and sleeve 10 provides an essential common ground and a three-conductor cable carries the audio to the Right channel Earphone 13 and Left channel Earphone 14 to produce stereo sound in each of the two earpieces.

Figure 1B:
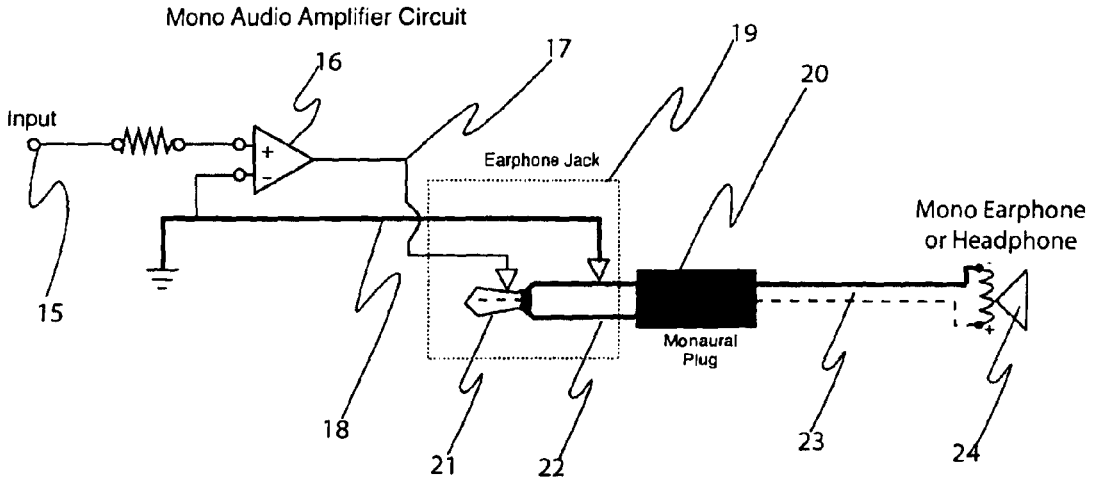
FIGURE 1B Prior Art
FIG. 1B is a drawing that depicts a conventional monaural circuit of an audio device, such as a transistor AM radio.

FIG. 1B is a drawing that depicts a conventional monaural circuit of an audio device, such as a transistor AM radio. The audio signal 15 is amplified to produce sound 16 that is capable of driving a headphone or earphone 21 by way of a two conductor earphone jack 18. A Mono earphone or headphone 21 consisting of a two conductor plug 19, cord 20 and single earpiece 21 is plugged into the Earphone jack 18 to conduct the audio from the single channel audio circuit output 16 and ground 17 to send the audio into the listener's ear.

FIG. 2A is a drawing that demonstrates what occurs when a two-conductor Mono earphone plug is inserted into a three-conductor stereo audio earphone jack. The left audio output 31 travels to the earphone jack 33 to deliver the left audio signal to the plug tip 34 that is inserted into the earphone jack 33. The audio output from the Right channel output at 32 travels to the Earphone jack connector 37 and connects to the sleeve 35 of the mono earphone plug 38. The common ground of the audio circuit connects to the earphone jack and also makes contact with the sleeve 35 of the mono plug 38 and thus the right audio channel is essentially shorted to ground, creating potential damage to the right channel audio circuit. Any audio present in the right channel 32 is routed to ground 36 and will not be heard by the listener in the mono earphone or headphone 39.

The drawing in FIG. 2B depicts a conventional monaural circuit and demonstrates what happens when a 3-conductor stereo headphone or earphone plug is inserted into a 2-conductor mono earphone jack. The amplified audio present at 40 travels to the Earphone Jack 43 and connects through the connection 41 to the tip 47 of the three-conductor earphone plug 44. The ground connection 42 makes contact with the sleeve 49 completing the two-wire circuit for the left earphone 46 only. The right earphone 45 connects to the ring of the stereo plug 49 and because the center ring of the stereo plug 44 does not connect to anything at all, no audio is delivered to the right earpiece 45. If the stereo plug 44 is pulled out slightly from the earphone jack 43, the contact 42 may connect briefly to the ring 48 of the earphone plug, leading some to speculate that there is a connection problem in the earphone jack 43, when in reality the problem is due to the incompatibility of the earphone with the circuit and jack.

FIG. 3A shows what happens when the described single earpiece headphone invention is used with a stereo circuit. The Left Audio exits from the amplifier circuit 50 and is directed to the Earphone Jack 55 and the internal pin 52 makes contact with the tip 52 of the stereo plug 59, sending audio through R1 to 61 to the + side of the Airbed 63. The Right Channel audio 51 connects to the Earphone Jack 55 at the connector pin 53, making contact with the ring 57 of the three-conductor plug 59, conducting audio through R2 to 62 where it makes contact with the + side of the Airbed 63. The common Ground 55 makes contact with the sleeve 58 to provide the common connection 60 to the negative side of the Airbed 63. The audio is combined where 61 and 62 join together at the Airbed 63 to mix the Left Channel 50 audio with the Right channel 51 audio, so both channels are heard in one earpiece. The Single Earpiece headphone (or earphone) functions perfectly with the stereo system, and the listener can hear both the left and right channels of the audio together in the same ear.

FIG. 3B shows what happens when the described single earpiece headphone invention is used with a monaural circuit. The amplified audio 65 enters the Earphone Jack 67 and makes contact 66 with the earphone plug tip 68 to send the audio into R1 and through 73 to the plus side of the earphone 76. The Common ground side of the amplified signal connects 71 to the earphone jack 67 and makes connection with the sleeve 70 of the three-conductor plug 72 connecting the ground side of the audio circuit 75 to the minus side of the Earphone 76 to complete the audio circuit, delivering the monaural sound to the Earphone 76, demonstrating that the same earphone used in FIG. 3A above also works with the monaural circuit shown in FIG. 3B.

FIG. 4A shows the preferred embodiment of the described invention. In this diagram, the 3-conductor stereo connector connects to the single earpiece headphone or earphone 87 by way of a two or three conductor cable. The tip 80 of the connector is routed via the cable 86 to the plus side of the single earpiece earphone. The center ring 81 of the connector also joins the plus side of the 87 single earpiece, and the connector plug 83 sleeve 82 connects to the negative side of the earpiece via 84 the shield of the audio cable. In this configuration, the left and right audio channels are joined together without any buffering, and while this circuit typically will work, it may be problematic for some audio circuits.

FIG. 4B shows another embodiment of the described invention, wherein each of the three conductors of the three-conductor plug 83 connects to an individual section of the voice coil of the Earphone 90. A center tap 83 of the voice coil is wired via the connector cable 88 to the ring 81 of the 3-conductor plug 83. The plus side of the earphone 89 is wired to the connector tip 80 and the negative side of the earphone 90 is wired 84 to the sleeve 82 of the 3-conductor stereo plug 83. In this configuration, the audio from the left and right channels are mixed together right inside the earphone, delivering a full range of the audio from both the left and right channels.

FIG. 4C shows another embodiment of the described invention. In this drawing, the Left Channel audio makes contact with the connector plug 83 tip 80 and carries the left channel audio through the cable to resistor R1 92. The Right Channel audio makes contact with the connector 83 ring 81 and caries the audio to resistor R2 91 and the audio from R1 92 is joined together with the audio at resistor R2 91 at the plus side 94 of the earphone 95. The common ground side of the audio circuit makes contact with the connector 83 sleeve and carries the audio up the cable 84 to the negative side of the earpiece. In this configuration, the two resistors create a balanced separation between the left and right audio channels, so that the right and left channels maintain sufficient electrical separation for normal operation.

FIG. 5A is a pictorial drawing of a single Earphone 106 which has a rubberized ear tip 105 which is inserted into a person's ear. A strain relief 107 helps to prevent the 3-conductor cord 108 from being damaged during active use of the whole assembly. The 3-conductor cord 108 is terminated into a plug assembly 101 and the plug has a standardized 3.5 mm (⅛-inch) plug 102, 103, and 104. The plug sleeve 102 is common to both audio channels and will connect to an audio circuit ground connection when the plug is inserted into a jack. The ring 103 of the plug will connect with the right audio channel of a stereo audio circuit when the plug is inserted into a corresponding stereo device jack. The tip 104 of the plug will connect with the left audio channel of a stereo audio circuit when the plug is connected into the jack of a stereo audio device.

Referring to FIG. 5B, the diagram shows the preferred embodiment of the schematic drawing of the described invention. The three-conductor audio plug 112 shown may be inserted into a monaural two-conductor jack or stereo three-conductor jack to provide audio to the earpiece 120. When the plug is inserted into a stereo system jack, the tip 109 makes contact with the Left channel of the stereo audio and directs the audio through the connector 112 and up the cable 114 to a resistor 116. The resistor 116 joins the resistor 117 at the positive side of the audio earpiece 120 voice-coil 118. The plug ring 110 conducts through the jack to the 3-conductor cable 115 making contact with the resistor 117. The opposite end of the resistor 118 is tied to the positive side of the earpiece 120 voice coil 118. The sleeve 111 conducts from the ground circuit side of the audio jack through the plug to the 3-conductor cable wire 113 to the negative side of the earpiece 120 voice-coil 119. This completes the audio circuit to allow audio to be heard at the earpiece 120. The resistor 117 and resistor 116 are each carrying separate signals from the stereo device that the plug 112 is plugged into. The two resistors are joined at 118 and there the audio is mixed together so that the combined audio is played through the single earpiece 120.

In an alternative embodiment, the resistors may be placed inside the plug 112 if so desired, and the common point for resistors 116 and 117 may connect to point 118 enabling a two-conductor cable to be used with the earphone in place of a three-conductor cable. The value of the resistors is dependent upon the audio circuit that the plug is inserted into, in order to optimize the impedance and prevent the left channel from interfering with the right channel in some audio devices. In essence, the resistor values can be zero, and in most cases the resulting audio will not be affected. If any interference occurs between the operation of the left and right channels of the audio player, the resistance values may be increased equally in both resistors 116 and 117 to equally sum the audio coming from the stereo device's right and left audio channels.

The plug 112 may also be inserted into a monaural audio jack, and the tip 109 will conduct the audio through the plug 112 up to the positive side of the earphone 120 voice coil 118 through resistor 116. The sleeve 111 will make contact with the ground side of the monaural jack to conduct up through plug 112 and wire 113 to the negative side of the earphone 120 voice coil 119 to complete the audio circuit for monaural audio to be heard in the earpiece 120.

The described earphone may be used with a plurality of stereo and monaural audio devices, enabling the listener to hear all of the audio content presented by the audio device. When plugged into a stereo audio device, the listener will be able to hear both the left channel audio and right channel audio summed together into a single earpiece, without the need for any type of switch, adapter or sensing circuit. This will enable individuals who wish to hear the sound from their favorite audio device in a single ear by simply plugging the 3-conductor plug into the associated 3-conductor or two-conductor audio jack of all kinds of consumer audio devices.

Those who suffer from single sided deafness will find the convenience of the associated earphone or headphone to be a solution to their current inability to listen to both the audio channels of most commercially made stereo audio devices. Those who have no hearing impairment will enjoy the convenience and safety factors of being able to listen to audio with one ear while their other ear helps to maintain contact with those around them. The addition of this product to the marketplace will fill a much-needed void in the marketplace and it will serve the public need.

A single Airbed style earphone employing a standard three-conductor stereo headphone plug is adapted to enable the use of one earpiece to hear the combined left and right channels of stereo audio in a single ear. This single stereo Airbed configuration is beneficial to those who have a hearing loss in one ear, bringing these individuals the capabilities of hearing the combined left and right stereo channels from their stereo audio device. Common portable electronic stereo devices include computers, MP-3 players, compact disc players and various personal gaming players. Many individuals like to bicycle or jog while listening to their favorite music or audio-books, and this can be especially dangerous if the listener has audio playing in both of their ears, blocking out the nearby sounds of traffic and people who might be trying to communicate with them. Therefore the use of my invention, a single stereo Airbed, would enable joggers and bicyclists to get the full benefit of their stereo music in a single earpiece and it would enable them to keep the other ear free to hear the honk of a horn or possibly a warning shout by a nearby pedestrian. Some Marathon officials are beginning to ban runners from using audio players because the runners are unable to hear and communicate with others nearby, creating a safety hazard to all the runners. By offering people the use of a single stereo Airbed a listener could hear both audio channels without losing the ability to hear and communicate with those around them. Therefore the Marathon organizers might potentially allow the use of a single Airbed without compromising safety and the runners might be able to enjoy the stereo music channels mixed together and delivered into one ear. Many employers are banning the use of stereo arbutus in the workplace however some companies have allowed the employees to wear a single Airbed if the other ear is kept free to function safely on the job. A single stereo Airbed would make it possible for listeners to continue to work and listen to mixed stereo audio in a single earpiece while effectively communicating with those in their surrounding area.

Users who might attempt to plug a two-conductor monaural Airbed or monaural headphone into the stereo jack of their audio device, will typically only hear the audio from the left channel of their stereo system because the right channel audio is being shorted to ground, thus risking damage to the right channel audio amplifier circuit. If a person had a pair of stereo arbutus or headphones and plugged them into their mono audio player, the audio would only be heard in one earpiece, because of an incompatibility of the stereo plug and the mono jack. Our single Airbed invention employs a three-conductor plug and is wired in such a way that it may be used equally well with both stereo and mono audio devices without the need for any kind of adapter, switch or sensing circuit. Furthermore, it would do away with the need for any type of stereo-to-mono adapters, creating a cost savings. Such adapters are typically quite cumbersome to use and often lead to damaging the headphone plug, jack or adapter if the headphone cord snags on anything as the user moves about. Such adapters would also make it very difficult to put a portable audio player in a pocket, mainly because the stacked plug and adapter would stick out considerably from the typically small audio player.

Thus the scope of the invention should be determined by the appended claims and their legal equivalents, and not by the examples given.

I claim:

1. An audio earphone system having a single earpiece with a single earpiece speaker adapted to be electronically connected to either a sound system audio jack of a stereo sound device or a sound system audio jack of a monaural sound device, the audio earphone system comprising:

said single earpiece speaker having only one acoustical driver which is electronically connected and terminated in a three conductor audio plug, said three conductor audio plug adapted to be inserted into said audio jack of either said stereo sound device or said monaural sound device, resistors electrically coupled to different conductors in said audio plug, said resistors summing left and right channel stereo sound signals from said stereo system audio jack and monaural sound from said monaural system audio jack, said resistors having values which maintain an impedance match between said one acoustical driver and the coupled audio system, and said resistors delivering a summed signal into the one acoustic driver of said single earpiece speaker.

2. The audio earphone system according to claim 1, wherein said resistors sum both channels to generate a summed audio signal delivered to the single earpiece speaker without additional in-line adapters.

3. The audio earphone defined in claim 1 wherein the type of audio plug may be any type of three-conductor audio plug that will provide compatibility with an associated audio device.

4. The audio earphone system defined in claim 1 wherein said resistors maintain an optimal impedance match between the earphone speaker and the coupled audio device.

5. The audio earphone system defined in claim 1 including a connection cable between the audio plug and the earpiece speaker, which connection cable consists of at least two conductors.

6. The audio earphone system defined in claim 1 including a connection cable between the audio plug and the audio earpiece speaker, said connection cable consisting of at least three conductors and the audio earpiece speaker having a voice-coil therein, said resisters being a first and a second resistor and each resister having respective first and second terminal ends, the first terminal ends of said first and second resisters electrically connected together and electrically connected to said voice coil, and said second terminal end of said first resistor connected to one conductor of said three conductors in said three conductor audio plug and said second terminal end of said second resister connected to the another conductor of said three conductors in said audio plug such that said first and second resistors are remotely disposed with respect to said audio plug.

7. The audio earphone defined in claim 1 including a connection cable between the audio plug and the audio earpiece, said connection cable consisting of at least two conductors, said resisters being disposed in said audio plug, said resisters being a first and a second resistor and each resister having respective first and second terminal ends, the first terminal ends of said first and second resisters electrically connected together and connected to one of said two conductors, and said second terminal end of said first resistor connected to one channel connector in said audio plug, and said second terminal end of said second resister connected to the another channel connector in said audio plug, such that said first and second resistors are remotely disposed with respect to said audio earpiece.

8. The audio earphone system defined in claim 1 including a connection cable between the audio plug and the audio earpiece, said connection cable consisting of at least two conductors, said resistors being disposed in said audio plug.

* * * * *

UNITED STATES PATENT AND TRADEMARK OFFICE

CERTIFICATE OF CORRECTION

PATENT NO. : 8,666,098 B2
APPLICATION NO. : 12/317902
DATED : March 4, 2014
INVENTOR(S) : Barry Leper It is certified that error appears in the above-identified patent and that said Letters Patent is hereby corrected as shown below:

On the Title Page:

Item (57) ABSTRACT should read:

A single earbud style earphone employing a standard three-conductor stereo headphone plug is adapted to enable the use of one earpiece to hear the combined left and right channels of stereo audio in a single ear. The single earbud invention employs a three-conductor plug and is wired in such a way that it may be used equally well with both stereo and mono audio devices without the need for any kind of adapter, switch or sensing circuit. A pair of resistors matches the impedance load of a stereo headphone set.

Signed and Sealed this
Thirteenth Day of May, 2014

Michelle K. Lee

Michelle K. Lee
*Deputy Director of the United States Patent and Trademark Office*